United States Patent [19]

Prunbauer et al.

[11] Patent Number: 4,686,841

[45] Date of Patent: Aug. 18, 1987

[54] ROTATABLE MAGNETIC TUMBLER AND MAGNETIC LOCK CONTAINING SAME

[75] Inventors: Kurt Prunbauer, Herzogenburg; Erich Csapo, Vienna, both of Austria

[73] Assignee: EVVA-Werk Spezialerzeugung von Zylinder- und Sicherheitsschlossern Gesellschaft mbH & Co. Kommanditgesellschaft, Vienna, Austria

[21] Appl. No.: 785,558

[22] Filed: Oct. 7, 1985

[30] Foreign Application Priority Data

Oct. 9, 1984 [AT] Austria ..... 3214/84

[51] Int. Cl.[4] ..... E05B 47/00

[52] U.S. Cl. ..... 70/276; 70/365; 70/413

[58] Field of Search ..... 70/276, 413, 365

[56] References Cited

U.S. PATENT DOCUMENTS

| | | | |
|---|---|---|---|
| 3,570,287 | 3/1971 | Hallmann | 70/276 |
| 3,633,393 | 1/1972 | Hisatsune | 70/276 |
| 3,654,782 | 4/1972 | Heimann | 70/276 |
| 3,855,827 | 12/1974 | Hallmann et al. | 70/276 |
| 3,935,720 | 2/1976 | Boving | 70/276 |
| 4,084,416 | 4/1978 | Prunbauer | 70/276 |
| 4,220,021 | 9/1980 | Burger et al. | 70/276 |
| 4,250,725 | 2/1981 | Prunbauer | 70/276 |
| 4,253,320 | 3/1981 | Schwab et al. | 70/375 X |
| 4,333,327 | 6/1982 | Wake | 70/276 |
| 4,516,416 | 5/1985 | Prunbauer et al. | 70/276 |

FOREIGN PATENT DOCUMENTS

| | | |
|---|---|---|
| 341901 | 6/1977 | Austria . |
| 357430 | 11/1979 | Austria . |

*Primary Examiner*—Robert L. Wolfe
*Assistant Examiner*—Suzanne L. Dino
*Attorney, Agent, or Firm*—Karl F. Ross; Herbert Dubno

[57] ABSTRACT

A rotatable magnetic tumbler apparatus for a magnetic lock comprises at least one rotatable magnetic tumbler, whose rotary orientation is adjustable by a magnetic key corresponding to a preselected magnetic code, and which is contactable by a contacting element of the lock. The rotatable magnetic tumbler is movable in the direction of the rotation axis of the tumbler, and the contacting element is suitably mounted in the magnetic lock for making contact with the rotatable magnetic tumbler in a predetermined position on the rotation axis.

8 Claims, 2 Drawing Figures

ROTATABLE MAGNETIC TUMBLER AND MAGNETIC LOCK CONTAINING SAME

FIELD OF THE INVENTION

Our present invention relates to an improved magnetic lock and, more particularly, to an improved rotatable magnetic tumbler for a magnetic lock.

BACKGROUND OF THE INVENTION

Known rotatable magnetic tumbler locks for use with magnetic keys generally comprise at least one rotatable magnetic tumbler, whose rotary orientation is adjustable by a magnetic key corresponding to a preselected magnetic code and which is engaged by a contacting element of the magnetic lock.

This type of magnetic lock is known and described in detail, for example, in Austrian patent Nos. 341 901 and 357 430. These and similar locks have rotatable magnetic tumblers whose rotary orientation is set by a magnetic key belonging to it corresponding to a proper magnetic code, whereby in the correct lock opening orientation the rotatable magnetic tumbler can be engaged by a locking element of the lock to permit an opening movement of the bolt.

In the correct rotary orientation of the tumblers, for example, the contacting element can be slid or pushed into a recess or notch in the or each rotatable magnetic tumbler and the sliding motion controls for its part the position of a locking element, which causes the operation of the lock, its locking, or allows rotation of a lock cylinder.

This kind of lock can use, for example, a rotatable lock cylinder or a linearly movable lock slider.

In practice these locks in which rotatable magnetic tumbler apparatuses are used have problems related to the operation of the rotatable magnetic tumblers, as is subsequently described in greater detail below.

Specifically, when the rotatable magnetic tumblers are rotated to a new orientation by the magnetic key, because they have a finite mass, they can undergo pendulum-like oscillations about their desired positions, which may under certain conditions prevent the proper engagement of the contacting element of the magnetic lock with the tumbler, thus preventing proper operation of the lock.

Furthermore with certain particular key magnet configurations an incorrect or false key or even a correct key with dexterous manipulation may operate prior art rotatable magnetic tumbler systems As a result the lock may be opened by the false magnetic key should, for example, the rotatable magnetic tumbler be accidently in the open position just prior to engaging it.

OBJECTS OF THE INVENTION

It is an object of our invention to provide an improved rotatable magnetic tumbler for a magnetic lock.

It is also an object of our invention to provide an improved magnetic lock, in which there are no lock-opening failures due to pendulum-like oscillations occurring, when the rotatable magnetic tumblers are operated by the magnetic key.

It is a further object of our invention to provide an improved rotatable magnetic tumbler for a magnetic lock, in which the rotatable magnetic tumblers are so constructed and arranged, that pendulum-like oscillations occurring in prior art tumblers on operation are suppressed and/or eliminated.

It is yet another object of our invention to provide an improved rotatable magnetic tumbler for a magnetic lock, in which a false or incorrect key with a particular key magnet configuration can not improperly open the lock.

SUMMARY OF THE INVENTION

These objects and others which will become more apparent hereinafter are attained in accordance with our invention in a rotatable magnetic tumbler for a magnetic lock comprising at least one rotatable magnetic tumbler, whose rotary orientation is adjustable by a magnetic key corresponding to a preselected magnetic code, and which is contactable and engageable with a contacting element of the magnetic lock to permit movement of the latter in a proper orientation of the tumblers.

According to our invention the rotatable magnetic tumbler is movable in the direction of the rotation axis of the tumbler, and the contacting element is suitably mounted so as to be able to make contact with the rotatable magnetic tumbler in a predetermined position about its rotation axis.

Furthermore the movability of the rotatable magnetic tumbler is limited by two opposing bearing surfaces, on each of which an associated bearing of the rotatable magnetic tumbler can make contact. The one bearing closest to the position of the magnetic key, when inserted in the lock, is provided with a greater bearing friction than the other one of the bearings.

Thus, when the tumbler is rotated by a key magnet of the magnetic key, and the tumbler is attracted to the magnetic key, the pendulum-like oscillations of the rotatable magnetic tumbler are suppressed by the friction of the bearing closest to the magnetic key on the opposing bearing surface.

Preferably, the axial movability or the maximum axial displacement of the rotatable magnetic tumbler having a shaft about which it rotates amounts to between 10 and 80% of the length of the shaft.

According to another preferred embodiment of our invention the bearing closest to the position of the magnetic key, when that key is in the lock, has a substantially planar surface contacting its associated opposing bearing surface, while the other bearing is tapered to a point. Furthermore the planar surface is preferably circular.

Advantageously, the extent of the contacting element, or the breadth of that contacting element in a direction perpendicular to the direction that the contacting element contacts the rotatable magnetic tumbler, is greater than the distance from the bearing having the least friction to the closest edge of the rotatable magnetic tumbler, and smaller than the distance from the opposing bearing surface, on which the bearing with the least friction engages, to the edge of the rotatable magnetic tumbler closest to the bearing having the least friction, when the rotatable magnetic tumbler is released from engagement with the key magnet.

Particularly preferred is an arrangement within our invention wherein the rotatable magnetic tumbler is provided witn contacting disk positioned with clearance from a magnetic body mounted on the shaft of the rotatable magnetic tumbler. Advantageously this contacting disk is provided with at least one notch for engagement with the contacting element.

Thus, when a key magnet is slid into coincidence with a rotatable magnetic tumbler which should rotate the tumbler but also repel it, the key magnet will reliably rotate the tumbler without delay, so that the lock is not erroneously opened by an incorrect or faulty key.

Most advantageously, the shaft on which the magnetic body is mounted and the contacting disk are formed as a single piece.

The preferably cylindrical magnetic body can be surrounde by a jacket separated from the contacting disk, this jacket having a protruding peripheral edge adjacent the side of the rotatable magnetic tumbler closest the bearing having the least friction.

BRIEF DESCRIPTION OF THE DRAWING

The above and other objects, features, and advantages of our invention will become more readily apparent from the following specific description, reference being made to the accompanying highly diagrammatic drawing in which.

SPECIFIC DESCRIPTION

Figure 1:
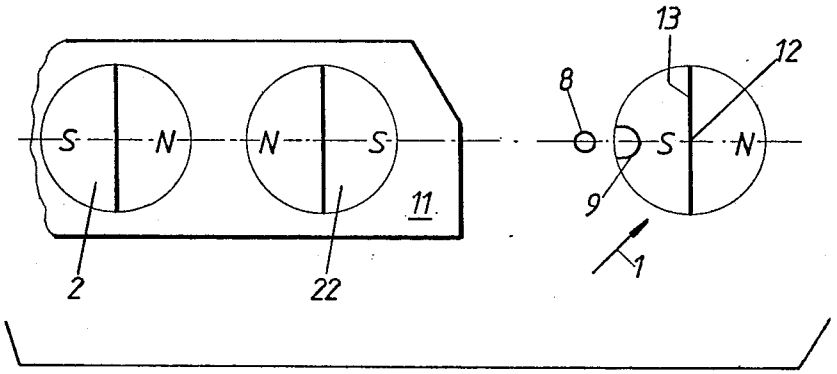
FIG. 1 is a schematic view of the key components of the magnetic lock according to our invention illustrating the basic problems of our invention.

From FIG. 1 some of the problems of the rotatable magnetic tumbler of the prior art will become somewhat more clear.

The rotatable magnetic tumbler 1 of the magnetic lock and the magnetic key 11 are shown in a configuration, before the key magnet 2 is positioned so as to coincide with the rotatable magnetic tumbler 1.

The rotatable magnetic tumbler 1 is freely rotatable about the rotation axis 12 and has both a north magnetic pole N and south magnetic pole S, whereby the magnetic separating line runs approximately radially across this preferably circular rotatable magnetic tumbler 1. Furthermore this rotatable magnetic tumbler 1 has a recess or notch 9, which can be engaged and can receive a contacting element 8 shown in more detail in FIG. 2, when the rotatable magnetic tumbler 1 is suitably oriented. This is indicated only schematically in FIG. 1. Engagement of the pin 8 in the notch 9 allows the shifting spring biased slider 17 to permit rotation of a cylinder core or other movement of the structure allowing the bolt of the lock to be withdrawn (see the aforementioned Austrian patents).

Figure 2:
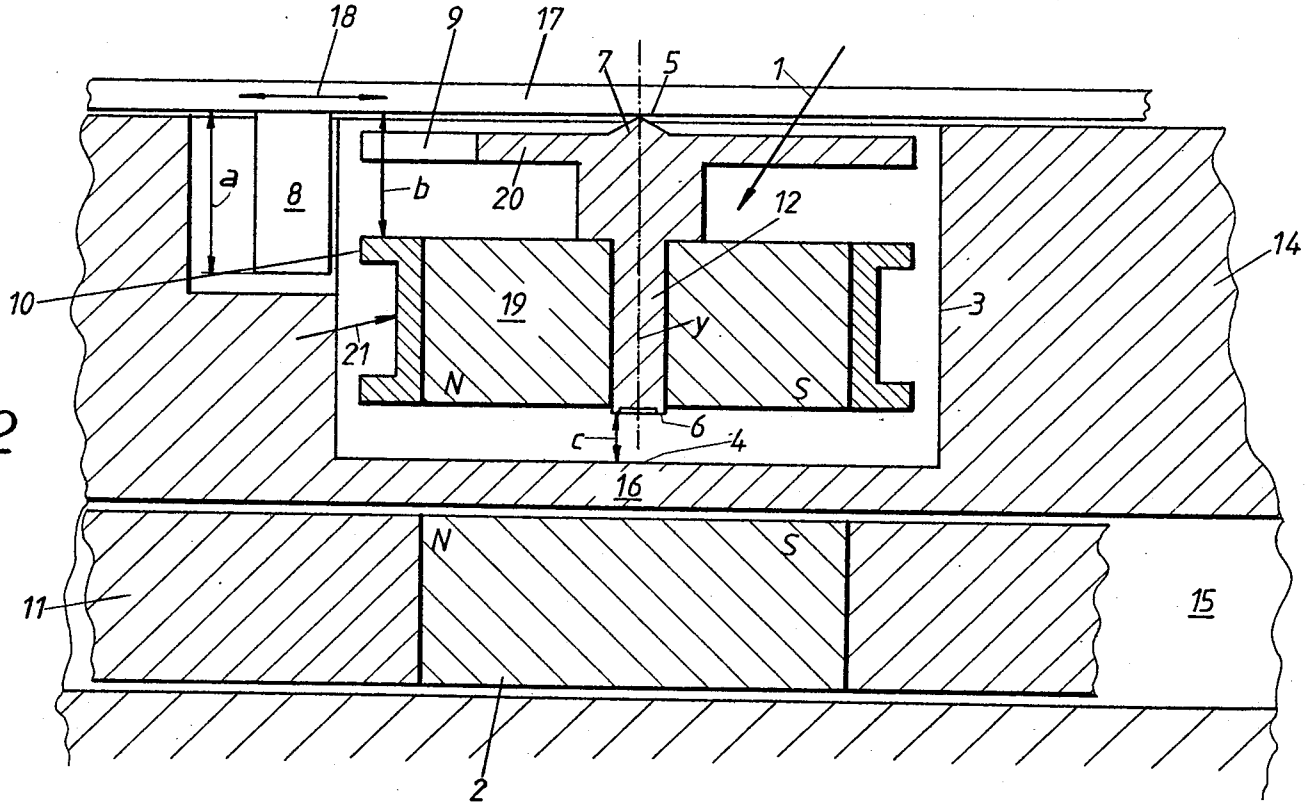
FIG. 2 is a cross sectional view of a preferred embodiment of the magnetic lock according to our invention.

The key 11 shown in FIG. 2 is a false key, since with its key magnet 2 it will tend to rotate the rotatable magnetic tumbler 1 into the locking position (about 180° from the indicated position), so that the contacting element 8 cannot pass into the notch 9, but instead bears against the circumferential surface of the rotatable magnetic tumbler 1.

However, it can happen that this false or incorrect key 11 can operate the lock if it is not provided with the improvement of FIG. 2.

The rotatable magnetic tumbler 1 is in the indicated unlocking position, which may be set by the key magnet 22, which is properly positioned at another rotatable magnetic tumbler of the lock, putting the rotatable magnetic tumbler shown into this position by sliding by it.

The coincidence of the key magnet 2 and of the rotatable magnetic tumbler 1 may result, then, not in a rotational moment that rotates the rotatable magnetic tumbler 1 approximately 180°, but in a merely repulsive force appearing between the N and S poles lying over each other and acting upon the tumbler which has no significant axial play. The contacting element 8 can therefore enter the notch 9 and the lock can be operated in spite of the fact that a false key 11 was used.

In a different case, in which the rotatable magnetic tumbler 1 is rotated by the orienting force of the key magnet 2, a problem of pendulum-like oscillations appears. These pendulum-like oscillations occur since the rotatable magnetic tumbler 1, because of its mass, does not immediately come to a stop in the correct orientation, but oscillates in both directions around this position. Conditioned by the mechanics of the lock it can happen that the contacting element 8, because of the pendulum-like oscillations, can not enter the notch 9, but pushes against the periphery of the tumbler 1, which holds the rotatable magnetic tumbler in an incorrect orientation and blocks the action of the lock.

With the aid of FIG. 2 it is now made clear that both the above described problems are solved according to our invention as follows:

FIG. 2 shows a rotatable magnetic tumbler of a lock cylinder, in whose cylinder core 14 the rotatable magnetic tumbler 1 is positioned in the chamber 3.

Parallel to the chamber 3 the key channel 15 is provided, into which the magnetic key 11 is inserted in such a way that the key magnet 2 is positioned opposite the rotatable magnetic tumbler 1.

The chamber 3 of the cylinder core 14 is closed by the wall 16 opposite the key channel 15 and on the side opposite to wall 16 by a contacting slider 17. The contacting slider 17 is slidable in the direction of arrows 18 and has mounted thereon contacting elements 8, one of which can enter in the notch 9 of the rotatable magnetic tumbler 1 in its correct orientation.

The rotatable magnetic tumbler 1 is freed as far as possible from inertia, that is, is constructed to be as light as possible, and comprises the preferably cylindrical magnetic body 19, and the contacting disk 20, which has at least one and sometimes several tumbler notches 9.

Further a jacket 21 is mounted around the periphery of the magnetic body 19, which protects the magnetic body 19, and on which a protruding edge 10 is formed.

The rotatable magnetic tumbler 1 can be moved up and down approximately by the distance c in the axial direction.

It is in an incorrect orientation 180° from the correct orientation in FIG. 2, so that when the rotatable magnetic tumbler 1 thus takes the orientation according to FIG. 1 opposite the key magnet 2, then the repulsive force between the south poles and north poles of the key magnet 2 and the tumbler magnet 19 pushes the rotatable magnetic tumbler 1 into the raised position shown in FIG. 2. Then the top pointed bearing 7 comes into contact with the opposing bearing surface 5 with minimal frictional force.

The protruding edge 10 has thus such a small clearance b from the opposing bearing surface 5 that the contacting element 8 can not enter the notch 9, but remains pressing or hanging on the protruding edge 10. Because of that the rotatable magnetic tumbler may rotate very quickly into the correct orientation under the influence of the key magnet 2. In the contruction shown, the length a of the pin 8 should be such that $(b+c)>a>b$.

As soon as the rotatable magnetic tumbler 1 has rotated 180°, the rotatable magnetic tumbler 1 is drawn by the South-North, North-South drawing force into its lower position, so that the bearing 6 comes into contact with the opposing bearing surface 4 and the friction force is increased. Because of that increased friction generated by the bearing 6 the pendulum-like oscillations are suppressed and/or eliminated.

The bearing 6 preferably has a circular shape, whereby the diameter of the circle determines the frictional force. The greater the diameter of the bearing, the stronger the suppression of oscillations.

The rotatable magnetic tumbler 1 has only very slight mass. The supporting governing mass component is the magnetic body 19, which is mounted on the shaft 12. The shaft 12 is formed in one piece with the contacting disk 20. The jacket 21 serves as a protection for the magnetic body 19 and is formed in FIG. 2 with a U-shaped cross section. The lower leg of the U can be omitted as seen in FIG. 2, since here only the upper leg forms the protruding edge 10.

The displacement during raising and lowering of the tumbler 1 amounts to preferably 10 to 80%, and especially 30 to 40%, of the length y of the shaft 12. The arrangement and structure of the rotatable magnetic tumbler 1 according to our invention with the displacement c provided to ensure proper tumbler orientation is in no case limited to the particular structure for the remainder of the rotatable magnetic tumbler apparatus shown above. The opposing bearing surfaces 4 and 5 are formed in the present specific embodiment simply by the wall 16 and the contacting slider 17. They can also be formed by a bearing structure however.

We claim:

1. In a rotatable magnetic tumbler system for a magnetic lock, comprising:

at least one rotatable magnetic tumbler whose rotary orientation about an axis of the tumbler is adjustable by a magnetic key corresponding to a preselected magnetic code, and a contacting element engageable with said tumbler upon rotation by said tumbler in response to said code to enable manipulation of the lock by the key, the improvement which comprises:

means for mounting said rotatable magnetic tumbler to permit axial displacement of said tumbler along said axis and in the direction of said axis;

means for mounting said element in the lock for movement in a direction transverse to said axis and radial of said tumbler upon insertion of a correct key into said lock and proper magnetic alignment of said key with said tumbler in accordance with said code, said tumbler having an axial end juxtaposed with and adapted to bear against said element;

a projection on said element extending therefrom perpendicular to said direction of movement by a distance a; and means on said tumbler for blocking radial displacement of said element in the event of magnetic action of a key on said tumbler when said key is a wrong key and does not correspond to said code, by magnetic displacement of said tumbler in the direction of said axis toward bearing contact with said element, said means on said tumbler including an edge thereof spaced at a distance b from said axial end adapted to bear upon said element, where b is smaller than a by an amount which is less than a distance c equal to the axial displacement of said tumbler between axial positions thereof when said correct and wrong keys are respectively inserted in said lock.

2. The improvement defined in claim 1 wherein said means for mounting said rotatable magnetic tumbler to permit axial displacement of said tumbler includes a surface positioned for axial displacement with the other axial end of said tumbler.

3. The improvement defined in claim 2 wherein said axial ends of said tumbler are ends of a shaft extending along said axis and with which said tumbler and said edge are rotatable, said displacement c being between 10 and 80% of the length of said shaft.

4. The improvement defined in claim 3 wherein said other end bears upon said surface when said correct key is inserted into said lock, the friction with which said other end engages said surface being greater than the friction with which the first-mentioned axial end bears on said element.

5. The improvement defined in claim 4 wherein said first-mentioned end is formed with a point adapted to bear upon said element and said other of said ends has a substantially planar face adapted to bear against said surface.

6. The improvement defined in claim 5 wherein said planar face is circular.

7. The improvement defined in claim 5 wherein said tumbler comprises a magnetic body formed with said edge and spaced from said point, and a disk adjacent said point formed along its periphery with a notch adapted to receive said projection.

8. The improvement defined in claim 7 wherein said body has a jacket surrounding same and formed with a flange of a diameter at least equal to that of said disk and provided with said edge.

* * * * *